US006591921B2

(12) United States Patent
Jenne

(10) Patent No.: US 6,591,921 B2
(45) Date of Patent: Jul. 15, 2003

(54) HORIZONTAL BORING APPARATUS

(75) Inventor: Dietmar Jenne, Strengelbach (CH)

(73) Assignee: Terra AG fuer Tiefbautechnik, Strengelbach (CH)

( * ) Notice: Subject to any disclaimer, the term of this patent is extended or adjusted under 35 U.S.C. 154(b) by 0 days.

(21) Appl. No.: 09/894,724

(22) Filed: Jun. 28, 2001

(65) Prior Publication Data

US 2002/0014353 A1 Feb. 7, 2002

Related U.S. Application Data

(63) Continuation-in-part of application No. 09/625,365, filed on Jul. 26, 2000.

(51) Int. Cl.[7] ..... E21B 19/15; E21B 21/06; E21B 21/10

(52) U.S. Cl. ..... 175/203; 175/206; 175/217; 175/52

(58) Field of Search ..... 175/52, 85, 162, 175/203, 206, 217, 218

(56) References Cited

U.S. PATENT DOCUMENTS

| | | | | |
|---|---|---|---|---|
| 2,838,282 | A | 6/1958 | Colquitt | 255/19 |
| 3,406,768 | A | 10/1968 | Miller | 175/162 |
| 3,411,596 | A | 11/1968 | Robbins | 175/85 |
| 3,470,968 | A | 10/1969 | Melsheimer et al. | 173/24 |
| 3,491,844 | A | 1/1970 | Kelly, Jr. | 175/398 |
| 3,845,828 | A | 11/1974 | Taylor et al. | 175/73 |
| 3,968,845 | A | 7/1976 | Chaffin | 175/60 |
| 4,049,065 | A | 9/1977 | Walter | 175/52 |
| 4,204,849 | A | 5/1980 | Johnston | 55/310 |
| 4,474,254 | A | 10/1984 | Etter et al. | 175/206 |
| 4,493,382 | A | 1/1985 | Collins et al. | 175/206 |
| 6,074,153 | A | 6/2000 | Allen | 414/22.53 |
| 6,189,628 | B1 | 2/2001 | Jenne | 175/52 |
| 6,216,801 | B1 | 4/2001 | Jonnes | 175/65 |

FOREIGN PATENT DOCUMENTS

| | | | |
|---|---|---|---|
| EP | 0 512 594 A1 | 11/1992 | E21B/21/10 |

*Primary Examiner*—David Bagnell
*Assistant Examiner*—Jennifer H Gay
(74) *Attorney, Agent, or Firm*—McCormick, Paulding & Huber LLP

(57) ABSTRACT

A horizontal boring apparatus comprises a traveling framework (10) on which is arranged a boring ramp (18) for guiding a boring rod (19), a rod magazine (22) for receiving individual boring rod sections (19), a drive apparatus (24) for the travelling framework (10) and the boring rod (19). In addition, the horizontal boring apparatus is comprised of an operating station (14, 16), and a mixing apparatus for the preparation of flushing fluid. The mixing apparatus includes a mixing unit (32) having a mixing pump, and is arranged on the traveling framework (10) without a flushing fluid tank. The mixing apparatus has a first inlet port connectable with a flushing fluid source and at least one outlet port releasably connectable with a flushing fluid receiver.

10 Claims, 4 Drawing Sheets

HORIZONTAL BORING APPARATUS

CROSS REFERENCE TO RELATED APPLICATION

This application is a continuation-in-part of application Ser. No. 09/625,365 filed Jul. 26, 2000.

FIELD OF THE INVENTION

The invention concerns a horizontal boring apparatus including a travelling framework or boring carriage, onto which is arranged a boring ramp for guiding the boring rod, a rod magazine for receiving individual boring rod sections, a drive unit for the travelling framework and the boring rod, and an operator station, and a mixing apparatus for the preparation of flushing fluid with a mixing unit including a mixing pump.

BACKGROUND OF THE INVENTION

Horizontal boring apparatuses of the previously described type are known for the emplacement of pipes. With these a flushing fluid is used, which for example consists of a water-bentonite mixture, and is created in the mixing apparatus and then pumped into the borehole by means of a high-pressure pump.

In today's controllable horizontal boring apparatuses of the aforementioned type one differentiates essentially two forms of the apparatus. In the first form, the mixing apparatus is separated from the travelling framework and is arranged, for example on a truck. It includes a flushing fluid tank having a capacity of between 1,000 to 6,000 liters. A disadvantage of this solution is that the mixing apparatus must be provided with its own drive motor. Usually such a drive motor is a gasoline or diesel motor of 20 to 30 horsepower. Moreover, before the beginning of a boring procedure the mixing apparatus must be connected through a liquid conducting hose of sufficiently large size to the boring apparatus, which for each boring procedure requires additional set-up time.

In a second form of the apparatus, the complete mixing apparatus including the flushing fluid tank, is arranged on the travelling framework. This solution has the advantage that almost no set-up time is required for starting operation. But the capacity of the flushing fluid tank because of space and weight considerations is necessarily limited. This can especially lead to problems if long borings need to be undertaken and if the boring place is situated a great distance from a hydrant, or if on other grounds a sufficient feed of flushing fluid is difficult to maintain. Moreover, because of the space required for the flushing fluid tank only short boring rod sections can be used. Therefore, more time is required for boring rod section changes.

The invention has as its object the provision of a horizontal boring apparatus of the aforementioned type which, on one hand, requires little set up time for starting operation, and which on the other hand, offers the possibility of being able to prepare a sufficient amount of flushing fluid.

BRIEF DESCRIPTION OF THE INVENTION

The above object is solved in accordance with the invention in that the mixing unit is arranged on the travelling framework and has an inlet port releasably connectable with a liquid source and at least one outlet port releasably connectable with a flushing fluid receiver.

Whereas in previous solutions, the mixing unit and the flushing fluid tank are always fixedly connected with one another into one unit independently of whether the mixing apparatus is arranged on the travelling framework or to one side of the travelling framework, in the arrangement of the invention, the mixing unit is an individual unit separate from the flushing fluid tank. This separation of the mixing apparatus from the flushing fluid tank offers an abundance of possibilities and a high flexibility in the preparation of the required amount of flushing fluid, and indeed both in the case where the mixing apparatus is mounted on the travelling framework and in the case where the mixing apparatus stands separately, even though in the following essentially only the first case is discussed.

First of all the arrangement of the mixing apparatus on the travelling framework offers the possibility of coupling the mixing pump with the framework drive apparatus. A separate motor for the mixing pump can therefore be avoided.

Moreover, since the mixing apparatus is not necessarily connected with the flushing fluid tank there exists the further possibility of connecting the inlet port of the mixing apparatus directly to an external water source, for example a hydrant. The inlet port however also, as previously, can be connected with a flushing fluid tank, so that a releasable connection gives the possibility of connecting to a substitute tank when the first tank is empty or to switch to a substitute tank, with the first tank then in the intermediate time being again filled with water.

Likewise, the outlet port of the mixing apparatus can be directly connected with a high pressure pump for the delivery of the flushing fluid to the bore hole (pass through mixer without flushing fluid tank) or with a flushing fluid tank. In both cases, the mixing of the desired material, for example bentonite, to the water can be accomplished with the help of an injector, which is arranged downstream of the pressure side of the mixing pump, with the suction port of the injector being connectable with a source of the material to be mixed with the water.

In another embodiment the mixing apparatus has a first outlet port which is connectable with a flushing fluid tank, and a second outlet port connected with a high pressure pump for delivering the flushing fluid to the bore hole, with the pressure side of the mixing pump being selectably connectable with one of the two outlet ports. The mixing can again take place as previously described with the help of an injector arranged between the pressure side of the mixing pump and the first outlet port or between these and the flushing fluid tank. Preferably, the injector is arranged directly at the flushing fluid tank. If the flushing fluid tank, for example, is on the vehicle which also transports the material, for example Bentonite, to be mixed with the water, the material need not be transported to the boring carriage. Another possibility exists in that water and the material to be added to it are directly introduced to the flushing fluid tank and both substances are recirculated with the mixing pump until the desired mixture is achieved. Whereafter the mixing pump delivers the mixture under moderate pressure to the high-pressure pump through the second outlet port.

Advantageously, a flushing fluid filter is arranged in advance of the high-pressure pump in order to strain large pieces from the mixture and to thereby keep these large pieces from reaching the high-pressure pump.

Further features and advantages of the invention will be apparent from the following description, which in connection with the accompanying drawings explains the invention by way of exemplary embodiments.

DETAILED DESCRIPTION OF PREFERRED EMBODIMENT

Figure 1:
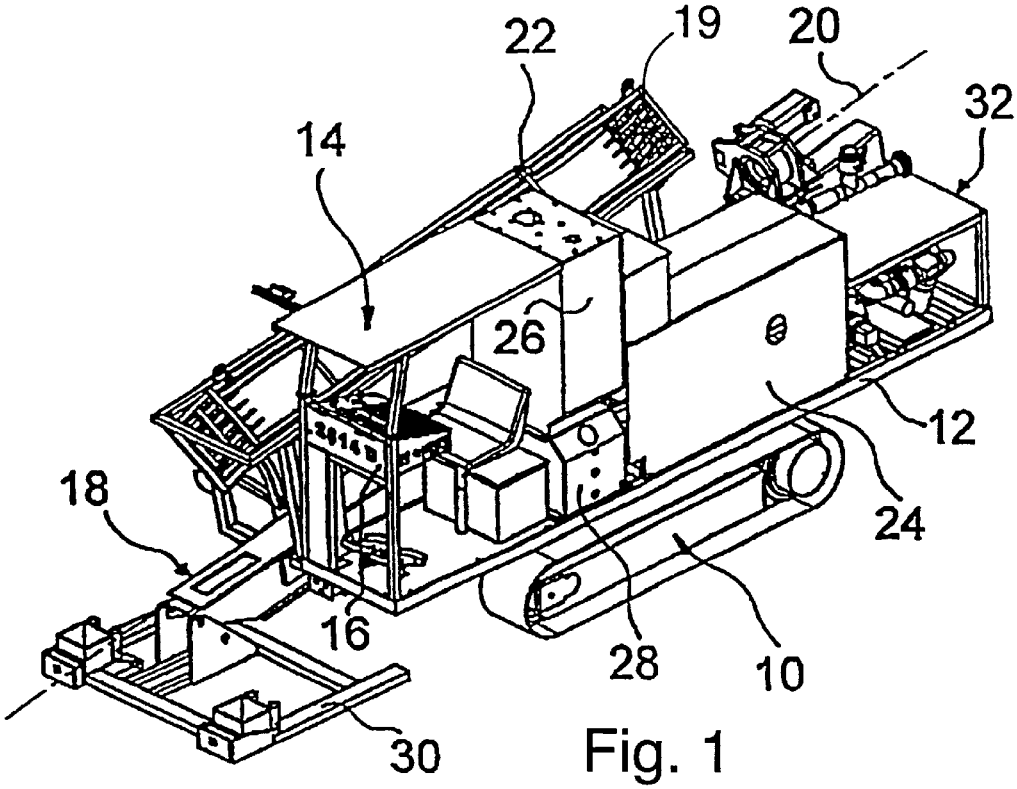
FIG. 1 is a partially schematic perspective total view of a horizontal boring apparatus in accordance with the invention.

A boring ramp 18 is also mounted onto the platform 12 where the ramp serves to guide the boring rod 19 in the direction of the axis 20 and contains in a way known in itself a non-illustrated rod section changer, for removing individual boring rod sections 19 from a rod magazine 22 and to return rod sections 19 to the rod magazine. Behind the driver's cabin 14 is a drive unit 24 for the boring apparatus, which unit contains the components of the hydraulic drive for the boring apparatus, including a diesel motor for driving the hydraulic pump. Between the drive apparatus 24 and the driver's cabin is an hydraulic tank 26 as well as a fuel tank 28 for the diesel motor. A ground plate 30 is fastened to the forward near to the earth end of the boring ramp 18, through which plate the entire boring apparatus is supported on the ground during operation. The above-described components are known in themselves and need not be explained in greater detail.

On the platform 12 behind the drive unit 24 is a mixing unit, indicated generally at 32, which will now be explained in greater detail.

The mixing unit 32 includes a housing or a frame 34 in which is arranged a mixing pump 36 and a high-pressure pump 38. The suction side of the mixing pump 36 is connected with an inlet conduit 40, which has an inlet port 44 closable by a valve 42. The pressure side of the mixing pump 36 is on one hand connected to a first outlet conduit 46 to which an injector 50 is connected through a turn-off valve 48, the injector 50 in turn having a first outlet port 52 and a suction port 56 closable by a valve 54.

On another hand, the pressure side of the mixing pump is also connected with the input 64 of the high pressure pump 38 through a pipe 58, a shut-off valve 60 and a filter 62, the high pressure pump 38 having an outlet 65 connectable in a non-illustrated way with the hollow boring rod 19 in order to pressurize the flushing liquid in the bore hole through the boring rod by a pressure of from about 50 to 150 bar.

The various possibilities for the connection of the mixing unit 32 with one or more flushing liquid sources and the ways in which the different variants function will now be described with respect to FIGS. 3–5.

Figure 3:
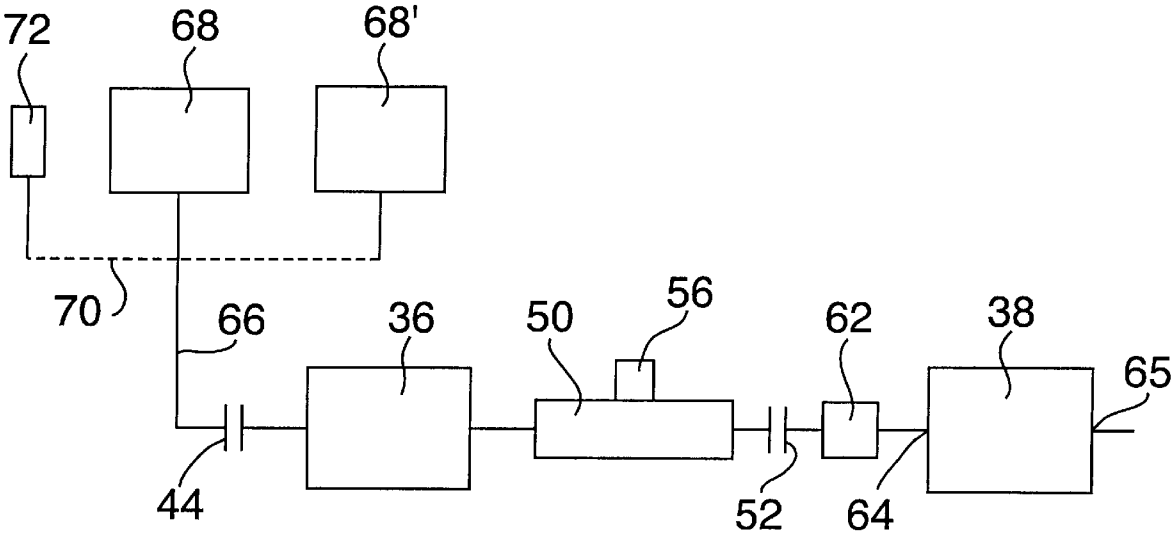
FIGS. 3–6 are each a schematic block circuit diagram, which show possible combinations of the mixing apparatus with one or more fluid sources.

FIG. 3 shows first a mixing apparatus which is setup as a "pass through" mixer. The mixing pump 36 is connected through the inlet port 44 and a pipe 66 to a water tank 68. The water tank 68 can have associated with it a reserve tank 68', so that the mixing pump 36 can be selectively connected with one of the two tanks 68, 68'. A further possibility is to connect the mixing pump 36 through the dashed illustrated line 70 directly to a hydrant 72, if such hydrant can be reached.

Figure 2:
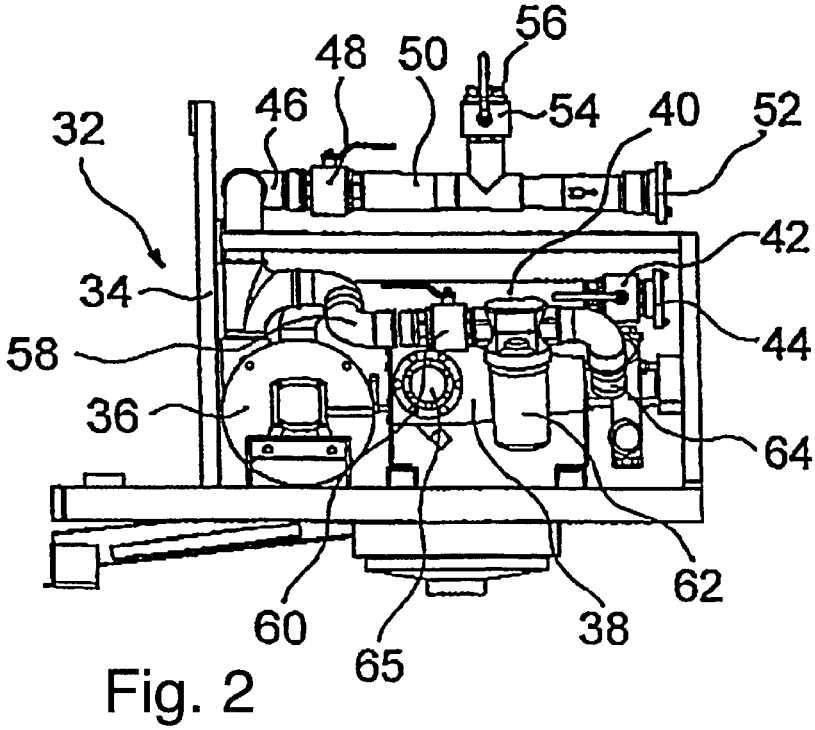
FIG. 2 is a schematic side view of a mixing and pumping aggregate for the flushing fluid.

As to its output side the mixing pump 36, in contrast to the illustration of FIG. 2, stands in direct connection with the high pressure pump 38 through the injector 50. When the water delivered by the mixing pump 36 flows through the injector 50 material to be mixed with the water, for example bentonite, is sucked up by the injector 50 through the suction port 56 and is mixed with the water in the injector 50. This mixture is delivered under a small positive pressure, of for example 0.5 bar, through the outlet port 52 and the filter 62 to the inlet port 64 of the high pressure pump 38, which then delivers the mixture through its outlet 65 to the boring rod 19.

Insofar as the bentonite delivery can be sufficiently precisely dosed with this procedure the time required for the preparation/mixing of a charge of the flushing liquid vanishes. In the case of connection to the hydrant 72 the need for tanks also disappears. Otherwise, only the water tanks 68, 68' are necessary.

Figure 4:
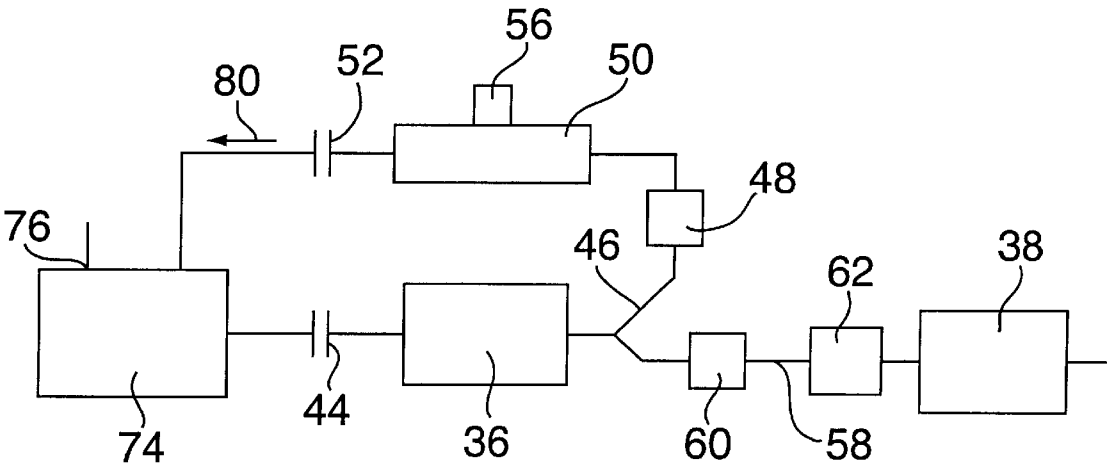

FIG. 4 shows a variant in which the outlet port 52 on the output side of the injector 50 is connected with an input of a flushing liquid tank 74, having a further inlet 76 for the delivery of water. The outlet of the flushing fluid tank 74 is connected with the input port 44 of the mixing pump 36. The pressure side of the mixing pump 36 is, as described in connection with FIG. 2, connectable by the valves 48 and 60 on one hand through the pipe 46 to the injector 50 and on the other hand, to the outlet port 58.

If the valve 48 is open and the valve 60 closed, for the preparation of a flushing liquid mixture, the water filled into the flushing fluid tank 74 is first repumped in the direction of the arrow 80 so that bentonite is mixed with it in the injector 50. This process can last for 5 to 10 minutes for each 1,000 liters of flushing fluid. After the preparation of the flushing fluid the valves 48 and 60 are reversely switched and the flushing fluid is delivered to the high pressure pump 38 by the mixing pump 36 under a light pressure of about 0.5 bar. By means of a sufficiently large flushing liquid tank 74 or several such tanks it can be seen to that a sufficiently large amount of flushing fluid stands available with practically no interruption. This is especially important because a large amount of the flushing liquid is needed during the drawing in of a pipe to be placed into the borehole. Since the flushing fluid in the case of an interruption in the process quickly congeals, the insertion of the pipe should take place without interruption, and this in turn presupposes a sufficient supply of flushing liquid.

Figure 5:
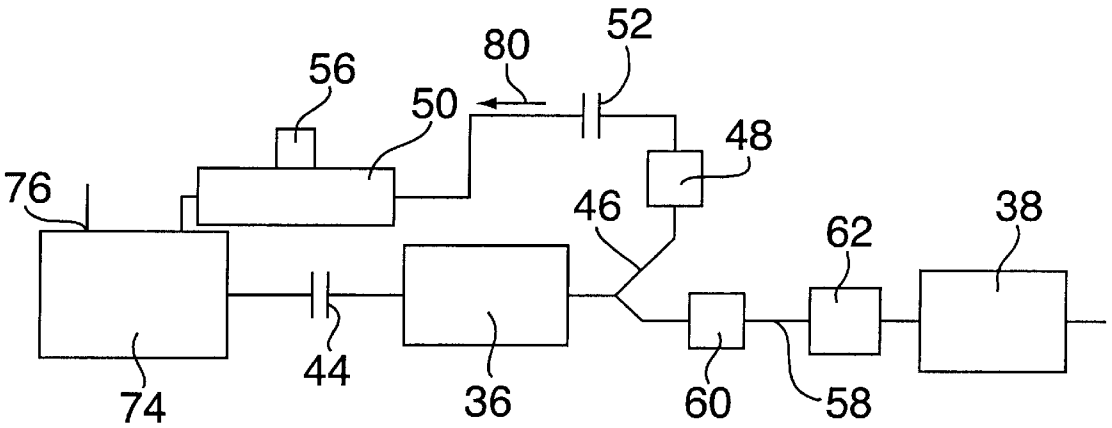

A preferred version of the FIG. 4 solution is shown by FIG. 5. In this the injector 50 is arranged near or directly on the flushing fluid tank 74, so that the material to be mixed need not be transported to the boring carriage.

Figure 6:
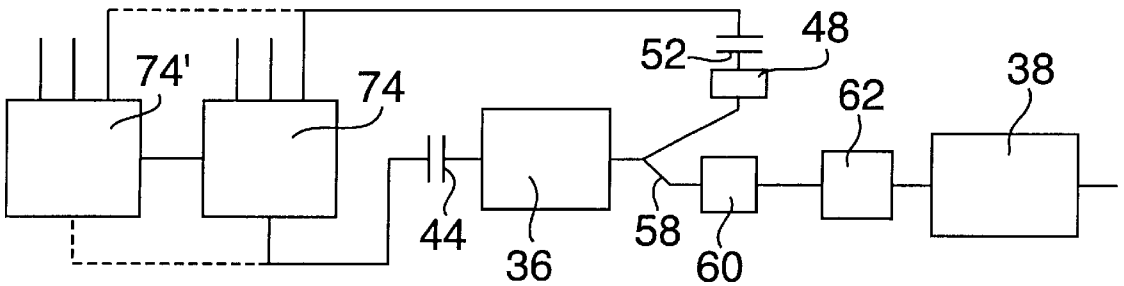

Finally, FIG. 6 shows a variant, which differs from those of FIGS. 3 to 5 in that no injector 50 is provided. In this case water and the material to be added, for example bentonite, is supplied to the flushing fluid tank 74. The mixing pump 36 circulates the mixture in the above way for an amount of time until a homogenous mixture exists, which mixture then can be delivered to the high pressure pump 38. In FIG. 6 a reserve tank 74' is also indicated which through non-illustrated valves can be selectively connected with the mixing pump 36, when the tank 74 is empty.

Figure 7:
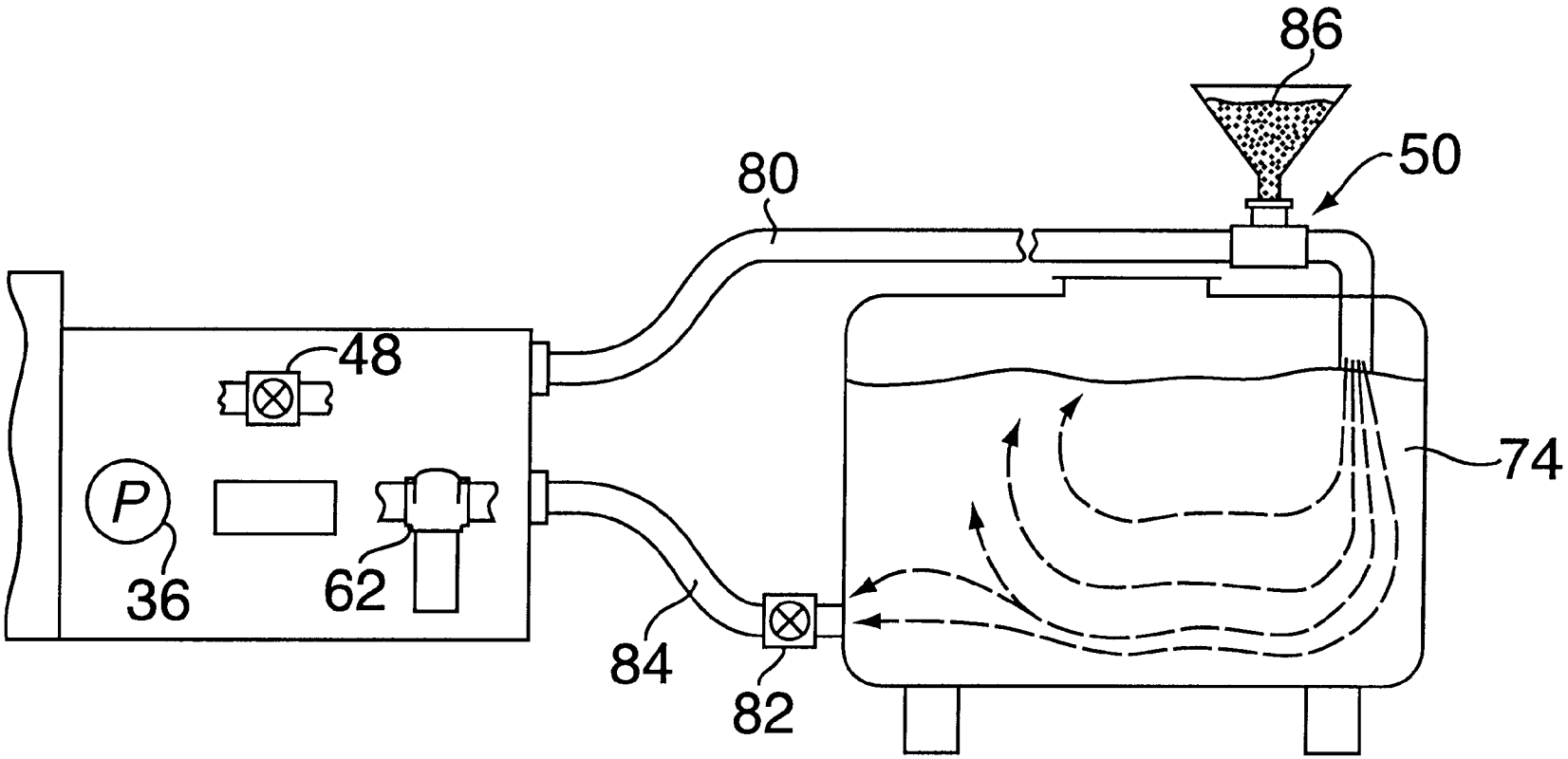
FIG. 7 is a view of a practical embodiment of the invention according to the scheme of FIG. 5.

The solution illustrated only schematically in FIG. 5 is more clearly shown in FIG. 7. Here the reference number 74 indicates the flushing fluid tank, the number 36 the mixing pump, the number 48 a ball valve in the pipe 80 to the injection 50, and the number 82 a ball valve in the return pipe 84 from the flushing fluid tank 74 to the mixing pump 36. A filter 62 serves to keep such dirt particles as might get into the tank during filling of the tank from reaching the flushing system of the boring carriage. The material (Bentonite) to be mixed is supplied by way of a funnel 86 (or by a pipe or hose).

One will recognize that the solution according to the invention offers an abundance of possibilities for the mixing unit to be connected with a liquid source or a flushing fluid tank according to need, which tank guarantees the supply of a sufficient amount of flushing fluid to the boring apparatus without large time wise interruptions.

What is claimed is:

1. A horizontal boring apparatus, said apparatus comprising a travelling framework (10), a boring ramp (18) on the travelling framework for guiding a boring rod (19), a boring rod section magazine (22) for receiving individual boring rod sections (19), a drive unit (24) for the travelling framework (10) and for the boring rod (19), an operating station (14, 16), and a mixing apparatus for the preparation of flushing liquid with a mixing unit (32) having a mixing pump (36) that is couplable to the drive unit (24), said mixing unit (32) being arranged on the travelling framework (10) and having an inlet port (44) connectable with a liquid source (68, 72, 74) and at least one outlet port (52) connectable with a flushing fluid receiver.

2. A horizontal boring apparatus according to claim 1, wherein the liquid source is an external water source (68, 72).

3. A horizontal boring apparatus according to claim 1, wherein the liquid source is a flushing fluid tank (74).

4. A horizontal boring apparatus according to claim 3, wherein a first outlet port (52) of the mixing unit (32) is connected with a flushing fluid tank (74) and a second outlet port (58) of the mixing unit (32) is connected with a high pressure pump (38) for delivering the flushing fluid to the bore hole, and the pressure side of the mixing pump is selectively connected with one of said first and second outlet ports (52, 58).

5. A horizontal boring apparatus according to claim 4, wherein the injector (50) is arranged between the first outlet port (52) of the mixing unit (32) and the flushing fluid tank (74).

6. A horizontal boring apparatus according to claim 4, wherein the injector (50) is arranged at the flushing fluid tank (74).

7. A horizontal boring apparatus according to claim 1, wherein the outlet port (52) is connectable with a high pressure pump (38) for delivering the flushing fluid to a bore hole.

8. A horizontal boring apparatus according to claim 7, wherein a flushing fluid filter (62) is arranged in advance of the high pressure pump (38).

9. A horizontal boring apparatus according to claim 1, wherein downstream of the pressure side of the mixing pump (36) is arranged an injector (50) having a suction port (56) connectable with a source of a material to be mixed with water.

10. A horizontal boring apparatus according to claim 9, wherein the injector (50) is arranged between the pressure side of the mixing pump (36) and the outlet port (52).

* * * * *